US006378465B1

(12) United States Patent
Austin

(10) Patent No.: US 6,378,465 B1
(45) Date of Patent: Apr. 30, 2002

(54) FULL-BODY SAFETY HARNESS

(75) Inventor: Barry J. Austin, Eagan, MN (US)

(73) Assignee: Protecta International, Inc., Houston, TX (US)

( * ) Notice: Subject to any disclaimer, the term of this patent is extended or adjusted under 35 U.S.C. 154(b) by 0 days.

(21) Appl. No.: 09/572,608

(22) Filed: May 17, 2000

Related U.S. Application Data

(60) Provisional application No. 60/159,863, filed on Oct. 15, 1999.

(51) Int. Cl.[7] ..... A62B 35/00

(52) U.S. Cl. ..... 119/770; 119/857; 182/4

(58) Field of Search ..... 119/770, 857; 182/3, 4; 244/151 R

(56) References Cited

U.S. PATENT DOCUMENTS

| | | | | |
|---|---|---|---|---|
| 2,443,191 A | | 6/1948 | Miller | 244/122 |
| 2,475,588 A | | 7/1949 | Bierman | 244/122 |
| 3,322,163 A | | 5/1967 | Hughes | 139/383 |
| 3,568,726 A | | 3/1971 | Thompson et al. | 139/415 |
| 3,807,798 A | | 4/1974 | Mattson | 297/386 |
| 3,872,895 A | | 3/1975 | Takada | 139/383 |
| 3,897,106 A | | 7/1975 | Takada | 297/389 |
| 4,004,616 A | | 1/1977 | Andronov et al. | 139/383 |
| 4,138,157 A | | 2/1979 | Pickett et al. | 297/386 |
| 4,479,267 A | | 10/1984 | Radowsky, Jr. | 2/2 |
| 4,662,487 A | | 5/1987 | Koch | 188/371 |
| 4,710,423 A | | 12/1987 | Imamura | 428/272 |
| 4,712,513 A | | 12/1987 | Huppertsberg | 244/151 R X |
| 5,259,338 A | | 11/1993 | Cornell | 119/770 |
| 5,487,444 A | | 1/1996 | Dennington | 182/6 |
| 6,006,700 A | | 12/1999 | Cox | 119/857 |
| 6,101,631 A | * | 8/2000 | Ferguson, Jr. | 244/151 R X |
| 6,125,475 A | * | 10/2000 | Taylor | 244/151 R X |

FOREIGN PATENT DOCUMENTS

| | | | |
|---|---|---|---|
| AU | 123515 | 2/1947 | |
| CA | 859487 | 12/1970 | 139/58 |
| EP | 1433059 | 4/1976 | |
| GB | 990331 | 4/1965 | |
| GB | 1124995 | 8/1968 | |
| GB | 1548574 | 7/1979 | |

OTHER PUBLICATIONS

Photographs (two) of Recreational Harness available from Rock Solid Manufacturing of Canada.
Photographs (four) of Harness Model 659N available from Bashlin Industries, Inc. of Grove City, Pennsylvania.

* cited by examiner

*Primary Examiner*—Robert P. Swiatek
(74) *Attorney, Agent, or Firm*—Mau & Krull, P.A.

(57) ABSTRACT

A full-body, fall-arrest harness includes a shoulder strap having opposite distal ends and an intermediate portion disposed there between, and a back strap having opposite distal ends and an intermediate portion disposed there between. A rear suspension assembly is interconnected between the intermediate portion of the shoulder strap and the intermediate portion of the back strap. A seat strap has opposite distal ends connected to respective ends of the shoulder strap, and an intermediate portion disposed there between. Left and right leg straps connected to the intermediate portion of the seat strap. The shoulder strap stretches more readily than any other strap on the harness, and the rear suspension assembly is configured to tighten the shoulder strap relative to the back strap in the event of a fall.

19 Claims, 4 Drawing Sheets

FULL-BODY SAFETY HARNESS

This application claims the benefit of U.S. Provisional Application No. 60/159,863, filed Oct. 15, 1990.

FIELD OF THE INVENTION

The present invention relates to full-body harnesses worn by humans for fall-arresting purposes.

BACKGROUND OF THE INVENTION

Various occupations place people in precarious positions at relatively dangerous heights, thereby creating a need for fall-arresting safety apparatus. Among other things, such apparatus usually include a safety line interconnected between a support structure and a person working in proximity to the support structure. The safety line is typically secured to a full-body harness worn by the worker. Obviously, such a harness must be designed to remain secure about the worker in the event of a fall. In addition, the harness should arrest a person's fall in as safe a manner as possible, placing a minimal amount of strain on the person's body. Yet another design consideration is to minimize the extent to which people may consider the harness uncomfortable and/or cumbersome.

Fall-arresting harnesses have been made with elastic straps to enhance user comfort and/or more evenly absorb or distribute impact associated with a fall. However, concerns exist about the effectiveness of these known elastic harnesses. In particular, if a conventional harness is modified simply by substituting elastic straps for inelastic straps, the containment capability of the harness may be compromised, and a person may slip from the harness during a fall and/or rebound. In other words, there remains a need for a harness which strikes an appropriate balance between user safety and user comfort.

SUMMARY OF THE INVENTION

One aspect of the present invention is the provision of a full-body safety harness having relatively more elastic shoulder straps and relatively less elastic other straps. Another aspect of the present invention is the provision of a full-body safety harness having shoulder straps which are secured to a D-ring and back pad assembly in such a manner that the D-ring changes position relative to the back pad in the event of a fall and thereby shortens the effective length of the shoulder straps. These two aspects are combined on a preferred embodiment harness constructed according to the principles of the present invention. The resulting combination makes the harness more comfortable during ordinary use while also ensuring user safety in the event of a fall. Additional features and/or advantages of the present invention may become more apparent from the detailed description which follows.

BRIEF DESCRIPTION OF THE DRAWING

With reference to the Figures of the Drawing, wherein like numerals represent like parts and assemblies throughout the several views.

Detailed Description of the Preferred Embodiment

Figure 1:
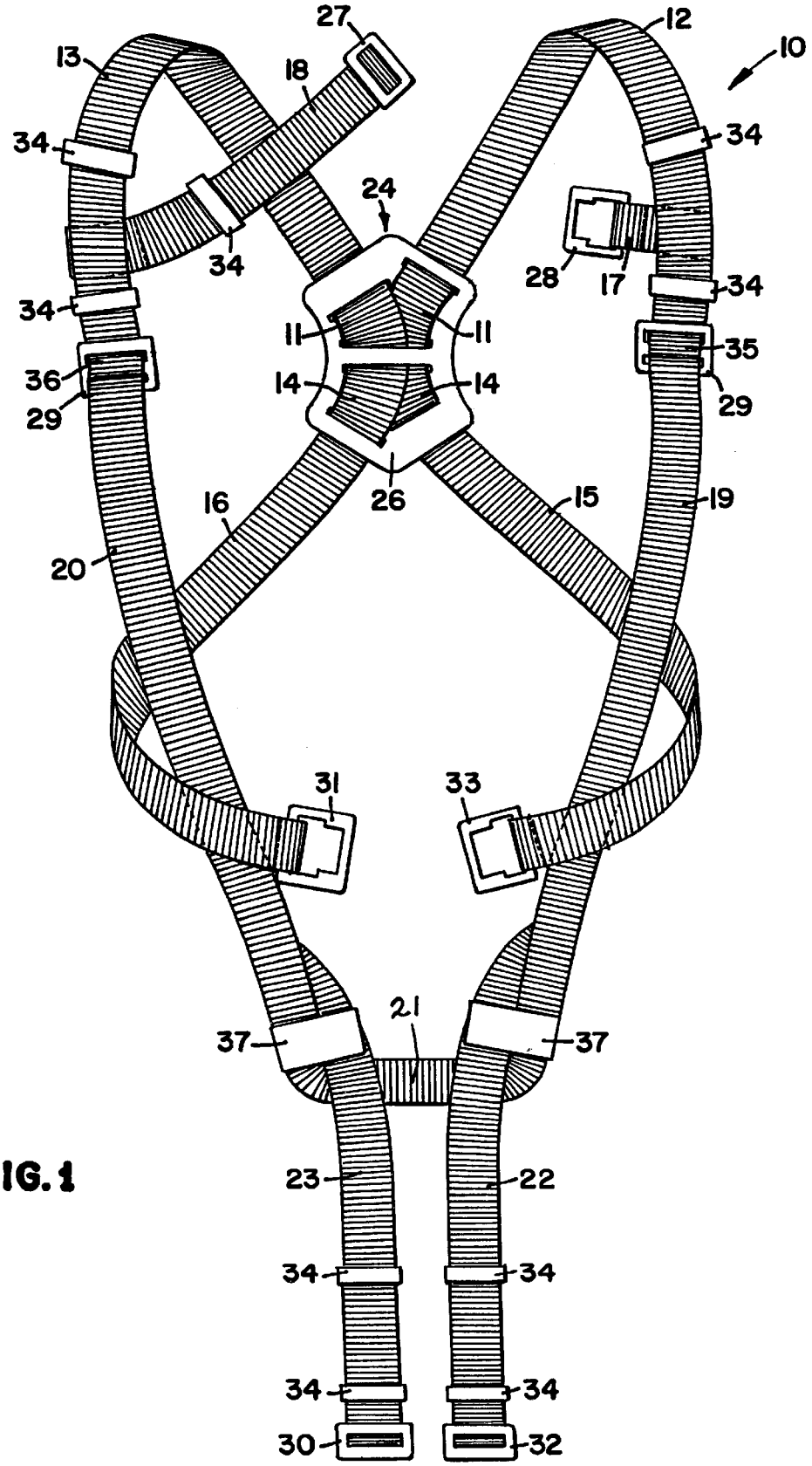
FIG. 1 is a front view of a preferred embodiment harness constructed according to the principles of the present invention.
Figure 5:
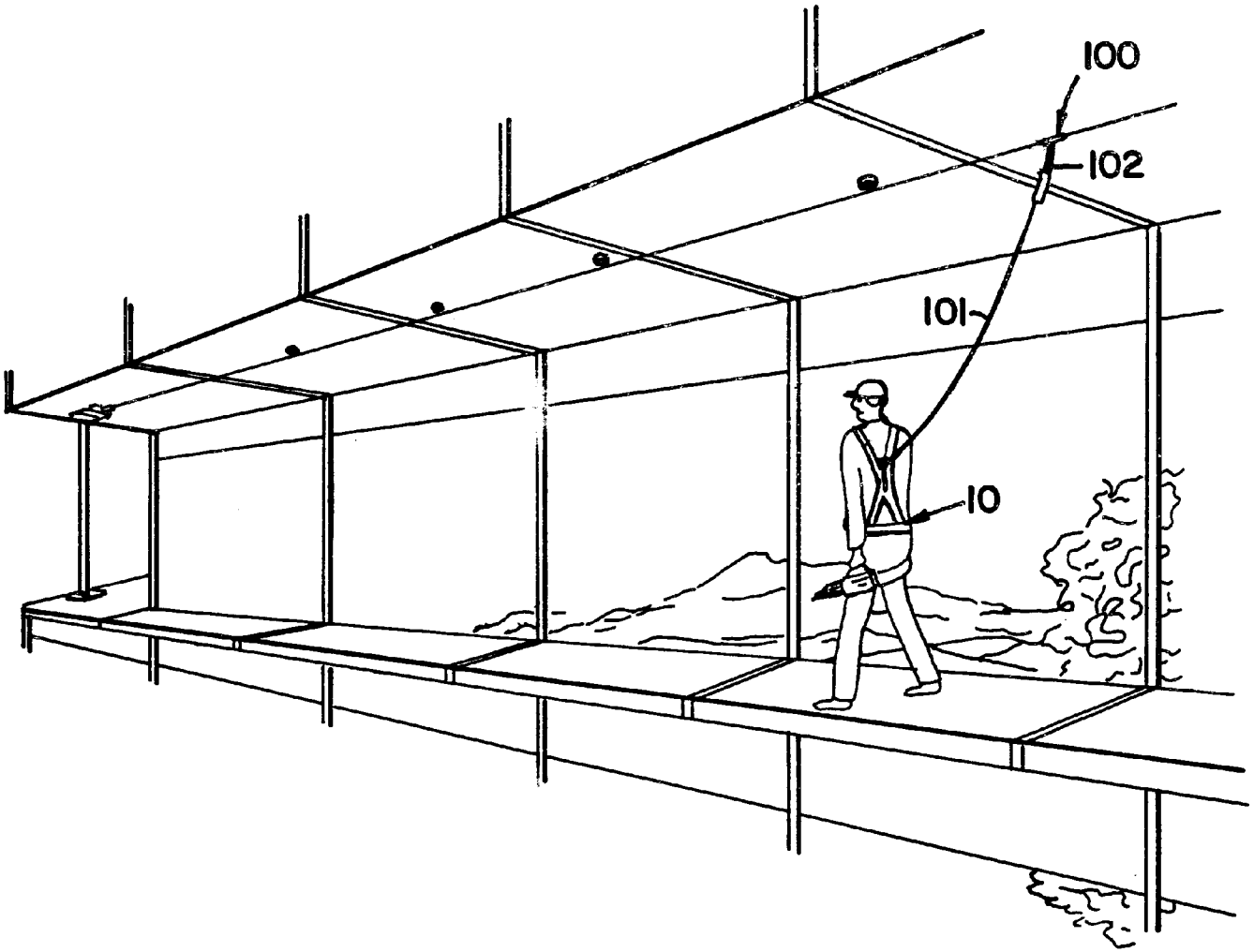
FIG. 5 is a perspective view of the harness of FIG. 1 secured to a person and connected to a support structure by means of a safety line and an energy absorbing member.

A preferred embodiment safety harness constructed according to the principles of the present invention is designated as 10 in FIGS. 1 and 5. The harness 10 is a full-body harness suitable for arresting the fall of a person. FIG. 5 shows a preferred application of the present invention, wherein the harness 10 is worn by a person and secured to a support structure 100 by means of a safety line 101 and an optional energy absorber 102.

The harness 10 may be described in terms of left and right shoulder straps 12 and 13, left and right back straps 15 and 16, left and right chest straps 17 and 18, a seat strap 21, and left and right leg straps 22 and 23. The shoulder straps 12 and 13 are integral portions of a single, continuous strap 11 of elasticized webbing which is preferably made by interweaving taut latex rubber cords with slack fibers of nylon and/or polyester. The weave is such that the webbing stretches between nine percent and twenty percent in length under a tensile load of less than fifty pounds. In other words, the slack in the relatively less elastic fibers is sufficient to allow the rubber cords to stretch at least twenty percent in length before the less elastic fibers become taut. The other straps on the harness are made from conventional harness webbing which is significantly less elastic (stretches less than two percent in length under a tensile load of less than fifty pounds).

A first end of the left chest strap 17 is formed into a closed loop about the left shoulder strap 12, and a second, opposite end of the left chest strap 17 is formed into a closed loop about a female buckle 28. A first end of the right chest strap 18 is formed into a closed loop about the right shoulder strap 13, and a second, opposite end of the right chest strap 18 is inserted through a male buckle 27 and retained in place by a keeper 34 on an intermediate portion of the strap 18. The male buckle 27 selectively interengages the female buckle 28 to interconnect the chest straps 17 and 18 across a person's chest. The length of the right chest strap 18 may be adjusted to accommodate people of different sizes.

A distal end segment 35 of the left shoulder strap 12 is inserted through a buckle 29 and adjustably secured thereto in a manner known in the art. Similarly, a distal end segment 36 of the right shoulder strap 13 is inserted through an opposite side buckle 29 and adjustably secured thereto. Keepers 34 are mounted on the distal end segments 35 and 36 to retain distal ends of the straps extending beyond the buckles 29. Each of the buckles 29 is secured to a respective "looped over" end segment 19 or 20 of the seat strap 21 by stitching or other suitable means known in the art.

The back straps 15 and 16 are integral portions of a single, continuous strap 14 of conventional, relatively inelastic webbing. A female buckle 33 is secured to a "looped over" end of the left back strap 15 by stitching or other suitable means known in the art. A similar female buckle 31 is similarly secured to a "looped over" end of the right back strap 16. Intermediate portions of the left back strap 15 and the left end segment 19 of the seat strap 21 are formed into closed loops about one another, and intermediate portions of the right back strap 16 and the right end segment 20 of the seat strap 21 are similarly formed into closed loops about one another. This sort of arrangement is disclosed in U.S.

Pat. No. Re 35,028 to Casebolt et al, which is incorporated herein by reference.

The leg straps 22 and 23 and the seat strap 21 are integral portions of a single, continuous strap. The leg straps 22 and 23 are fastened to respective intermediate portions of the seat strap 21 via both direct stitching and respective spacing tabs 37. Male buckles 32 and 30 are adjustably secured to respective leg straps 22 and 23, with the distal ends of the leg straps 22 and 23 retained in place by respective keepers 34. The male buckle 32 on the left leg strap 22 is sized and configured to interengage the female buckle 33 on the left back strap 15. Similarly, the male buckle 30 on the right leg strap 23 is sized and configured to interengage the female buckle 31 on the right back strap 16.

Figure 3:
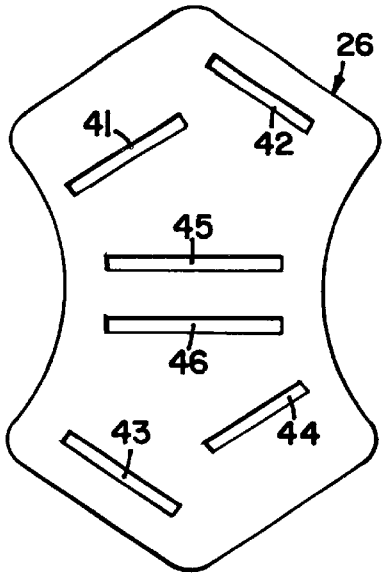
FIG. 3 is a rear view of a back pad on the rear suspension assembly of FIG. 2.
Figure 2:
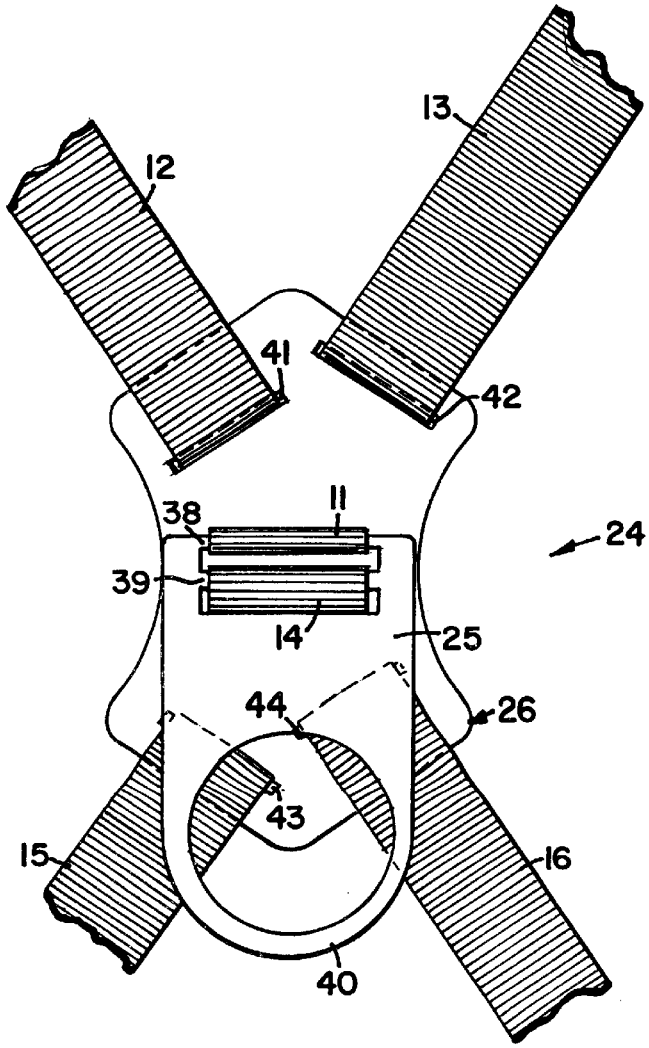
FIG. 2 is a rear view of a rear suspension assembly on the harness of FIG. 1 showing a D-ring in a downward disposition.
Figure 4:
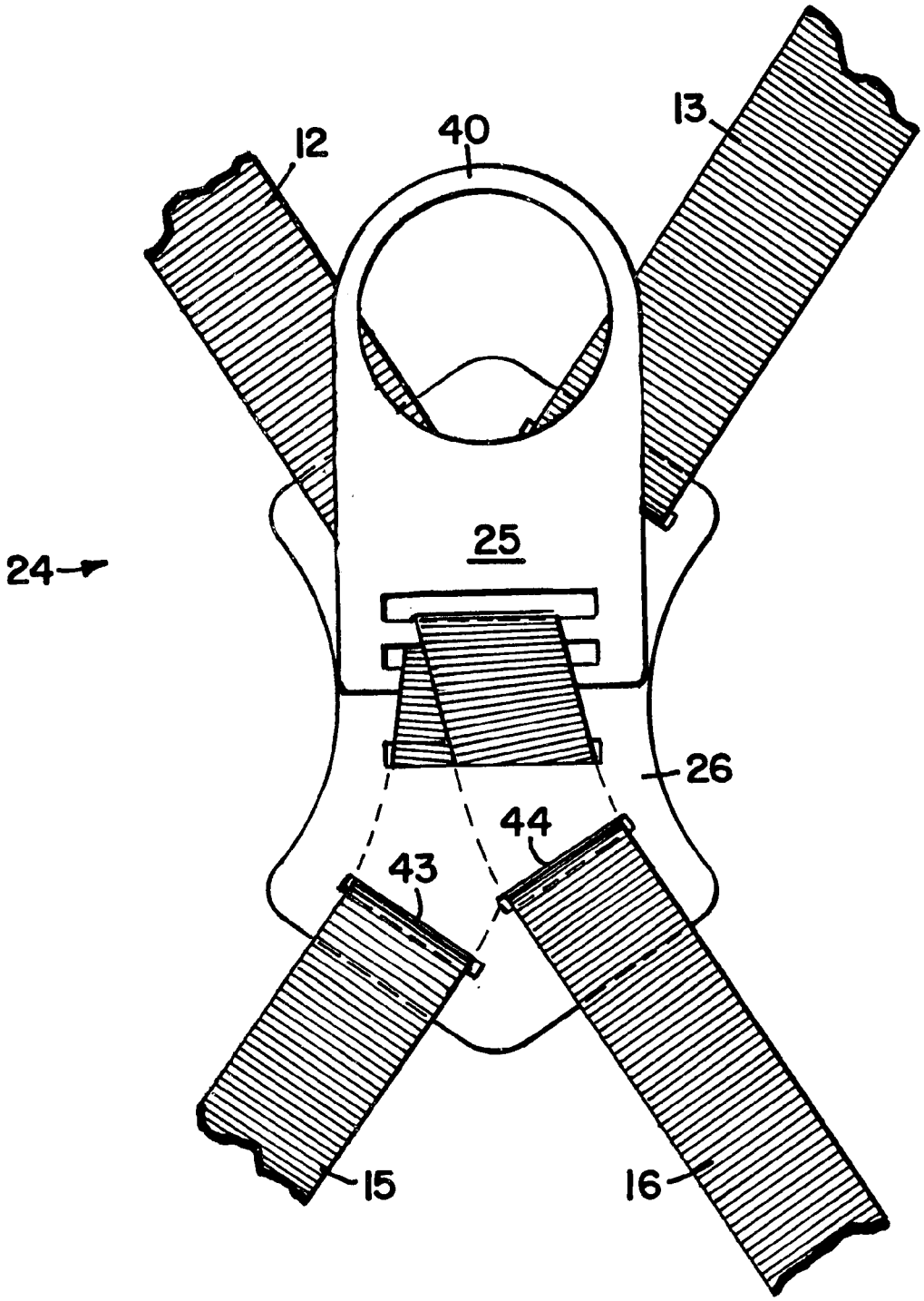
FIG. 4 is a rear view of the rear suspension assembly of FIG. 2 showing a D-ring in an upward disposition.

An intermediate portion of the shoulder strap 11 is routed through the back pad designated as 26 in FIGS. 2, 3, and 4 and about the D-ring designated as 25 shown in FIGS. 2 and 4. More specifically, the strap 11 enters the pad 26 through slot 41; then passes through slot 45, about an outer rung 38 on the D-ring 25, and back through the slot 45; then exits the pad 26 through slot 42. As a result of this arrangement, the rung 38 on the D-ring 25 is captured between the strap 11 and the back pad 26.

An intermediate portion of the back strap 14 is also routed through the back pad 26 and about the D-ring 25. More specifically, the strap 14 enters the pad 26 through slot 43; then passes through slot 46, about an inner rung 39 on the D-ring 25, and back through the slot 46; then exits the pad 26 through slot 44. As a result of this arrangement, the rung 39 on the D-ring 25 is captured between the strap 14 and the back pad 26.

When the D-ring 25 occupies the orientation shown in FIG. 2, with the ring portion 40 downwardly disposed, the looped portion of the shoulder strap 11 is disposed entirely above the looped portion of the back strap 14. In typical use of the harness 10, a safety line (such as that designated as 101 in FIG. 5) is secured between the ring 40 and a support structure (such as that designated as 100 in FIG. 5). As a result of the configuration of the harness 10, as well as the weight of the D-ring 25 and the safety line, the D-ring 25 tends to remain in the orientation shown in FIG. 2. However, in the event of a fall, the safety line pulls upward on the D-ring 25 and flips the ring 40 to an upwardly disposed orientation relative to the back pad 26, shown in FIG. 4. As a result of this flipping action, the shoulder strap 11 and the back strap 14 are pulled toward one another and into an overlapping relationship, thereby reducing both the effective size of the harness 10 and the likelihood that a person wearing the harness 10 will not be adequately supported. This self-cinching aspect of the harness 10 is particularly significant when used in conjunction with elastic shoulder straps 12 and 13, since the shoulder straps 12 and 13 are designed to stretch to a greater extent than conventional harness straps.

To don the safety harness 10, a person lifts the harness 10 by the D-ring 25 and ensures that none of the straps is twisted. The person places the shoulder straps 12 and 13 on his/her respective shoulders with the back pad assembly 24 draped across his/her back. The chest straps 17 and 18 are interconnected across the person's chest, and each leg strap 22 and 23 are secured to a respective back strap 15 or 16. The straps should be adjusted to the extent necessary to arrive at a snug, comfortable fit.

Although the present invention has been described with reference to a preferred embodiment and a particular application, this disclosure will enable those skilled in the art to recognize additional embodiments and/or applications which fall within the scope of the present invention. Accordingly, the scope of the present invention should be limited only to the extent of the following claims.

What is claimed is:

1. A self-cinching harness, comprising:

a plurality of straps secured into a harness configuration suitable for arresting a person's body during free fall, including left and right leg straps which complete respective loops about each leg of the body, at least one shoulder strap which completes a loop about each shoulder of the body, and at least one back strap which is interconnected between the leg straps and the at least one shoulder strap and completes a loop about the person's torso;

a back pad, wherein the at least one shoulder strap includes a left shoulder segment and a right shoulder segment which are conjoined at the back pad, and the at least one back strap includes a left back segment and a right back segment which are conjoined at the back pad; and a D-ring disposed adjacent the back pad, wherein each said shoulder segment extends through the back pad and is secured relative to a first, upwardly disposed rung on the D-ring, and each said back segment extends through the back pad and is secured to a second, interior rung on the D-ring, and a safety line is secured to a downwardly disposed loop on the D-ring, whereby if the person falls, the safety line pulls the loop upward, causing the D-ring to flip about an axis extending parallel to each said rung and forcing a portion of the shoulder strap to overlap a portion of the back strap.

2. The self-cinching harness of claim 1, wherein each said shoulder segment is made of webbing that stretches at least nine percent in length when subjected to a fifty pound tensile force.

3. The self-cinching harness of claim 2, wherein the left shoulder segment has a distal end which is connected to a left side strap which stretches less readily than the left shoulder segment, and the right shoulder segment has a distal end which is connected to a right side strap which stretches less readily than the right shoulder segment, and each said side strap is connected to a respective back segment.

4. The self-cinching harness of claim 3, wherein the left side strap and the right side strap are integral portions of a single strap.

5. The self-cinching harness of claim 2, wherein the leg straps and the at least one back strap are made of inelastic webbing which stretches less than two percent in length when subjected to a fifty pound tensile force.

6. A full-body safety harness, comprising:

a shoulder strap having opposite distal ends and an intermediate portion disposed there between;

a back strap having opposite distal ends and an intermediate portion disposed there between;

a means for interconnecting the intermediate portion of the shoulder strap and the intermediate portion of the back strap in such a manner that the shoulder strap and the back strap are tightened relative to one another in the event of a fall, wherein the means includes a back pad and a D-ring, and the shoulder strap extends through the back pad, around a first rung on the D-ring, and through the back pad again, and the back strap extends through the back pad, around a second rung on the D-ring, and through the back pad again;

a seat strap having opposite distal ends connected to respective ends of the shoulder strap, and an intermediate portion disposed there between; and left and right leg straps connected to the intermediate portion of the seat strap.

7. The full-body safety harness of claim 6, wherein the second rung is disposed between the first rung and a loop on the D-ring, and the loop is sized and configured to support an end of a safety line.

8. The full-body safety harness of claim 6, wherein the shoulder strap stretches more readily than any other strap on the harness.

9. The full-body safety harness of claim 8, wherein the shoulder strap stretches between nine and twenty percent in length under a tensile load of fifty pounds.

10. A full-body safety harness, comprising:

a shoulder strap having opposite distal ends and an intermediate portion disposed there between, wherein the shoulder strap stretches more readily than any other strap on the harness;

a back strap having opposite distal ends and an intermediate portion disposed there between;

a rear suspension assembly interconnected between the intermediate portion of the shoulder strap and the intermediate portion of the back strap in a manner that is relatively less constrictive under normal operating conditions, and relatively more constrictive in the event of a fall;

a chest strap interconnected between opposite side portions of the shoulder strap on a front side of the harness, generally opposite the rear suspension assembly;

a seat strap having opposite distal ends adjustably connected to respective distal ends of the shoulder strap, and an intermediate portion disposed there between; and left and right leg straps connected to the intermediate portion of the seat strap.

11. The full-body safety harness of claim 10, wherein the rear suspension assembly includes a back pad and a D-ring, and the shoulder strap extends through the back pad, around a first rung on the D-ring, and through the back pad again, and the back strap extends through the back pad, around a second rung on the D-ring, and through the back pad again.

12. The full-body safety harness of claim 11, wherein the second rung is disposed between the first rung and a loop on the D-ring, and the loop is sized and configured to support an end of a safety line.

13. The full-body safety harness of claim 10, wherein the distal ends of the back strap are connected to respective leg straps.

14. The full-body safety harness of claim 13, wherein opposite side portions of the back strap are engaged with opposite side portions of the seat strap.

15. The full-body safety harness of claim 10, wherein opposite side portions of the back strap are engaged with opposite side portions of the seat strap.

16. The full-body safety harness of claim 10, wherein opposite side portions of the shoulder strap extend upward from the rear suspension assembly, and opposite side portions of the back strap extend downward from the rear suspension assembly.

17. The full-body safety harness of claim 16, wherein the distal ends of the back strap are connected to respective leg straps.

18. The full-body safety harness of claim 17, wherein the opposite side portions of the back strap are engaged with opposite side portions of the seat strap.

19. The full-body safety harness of claim 18, wherein the opposite side portions of the back strap are engaged with opposite side portions of the seat strap.

* * * * *